US006141872A

United States Patent [19]

Takanashi

[11] Patent Number: 6,141,872

[45] Date of Patent: Nov. 7, 2000

[54] METHOD OF MANUFACTURING PRODUCTS HAVING A DEFORMABLE CONNECTION FOR FACILITATING MANUFACTURE

[75] Inventor: Hitoshi Takanashi, Yokkaichi, Japan

[73] Assignee: Sumitomo Wiring Systems, Ltd., Mie, Japan

[21] Appl. No.: 09/329,310

[22] Filed: Jun. 10, 1999

[30] Foreign Application Priority Data

Jun. 15, 1998 [JP] Japan ..... 10-167289

[51] Int. Cl.[7] ..... H01R 43/16

[52] U.S. Cl. ..... 29/874; 29/882; 29/884; 29/827

[58] Field of Search ..... 29/827, 830, 874, 29/875, 876, 877, 882, 884

[56] References Cited

U.S. PATENT DOCUMENTS 3,963,822 6/1976 Beck et al. .
4,037,915 7/1977 Cabaud .
4,783,906 11/1988 Gingerich et al. .
5,062,818 11/1991 Wasimoto et al. .

FOREIGN PATENT DOCUMENTS 444223 9/1991 European Pat. Off. ..... 29/874
4-366578 12/1992 Japan .

*Primary Examiner*—Carl J. Arbes
*Attorney, Agent, or Firm*—Oliff & Berridge, PLC

[57] ABSTRACT

A method of producing products wherein semi-finished products are supported between a pair of elongate, parallel carriers. Each semi-finished product is shaped by pressing the product into a finished form. Also, each semi-finished product is connected to at least one of the carriers by a deformable element. Deformation of the deformable element allows the semi-finished product to approach or move away from that carrier. Thus, when the semi-finished product is shaped by pressing, deformation of the deformable element allows the semi-finished product to move relative to that carrier so that unwanted tensions are relieved. Accordingly, the semi-finished product does not twist undesirably.

8 Claims, 9 Drawing Sheets

METHOD OF MANUFACTURING PRODUCTS HAVING A DEFORMABLE CONNECTION FOR FACILITATING MANUFACTURE

BACKGROUND OF THE INVENTION

1. Field of the Invention

The invention relates to a method of manufacturing a product, such as, for example, an electric terminal for use in a light bulb socket.

2. Description of Related Art

Many products are manufactured by a mass production process in which sections of material are produced (e.g., by punching sheet material) in a predetermined size and shape. These semi-finished sections of material are then fed sequentially to a processing machine which transforms them (e.g., by bending and optionally also by cutting) into a predetermined form. One example of such a process is a procedure for manufacturing electric terminals.

For example, one method of manufacturing electric terminals is disclosed in Laid-Open Japanese Patent Publication No. 4-366578. According to that method, a large number of rectangular, plate-shaped semi-finished terminals are each connected at one end to a common carrier element, which is long and narrow. The terminals are parallel and supported by their end which is connected to the carrier. The terminals are sequentially fed into processing machines which cut and bend the terminals by press working or the like. As a result, terminals having a predetermined shape are obtained. The terminals are then cut from the carrier.

Since in this method each semi-finished terminal projects from one side of the carrier, with one end of each terminal supported by the carrier, the method has a problem that the orientation and position of each semi-finished terminal is unstable while the terminal is being fed into the processing machines.

A modification of the above method is envisaged in which a pair of parallel, spaced carriers are provided, and each semi-finished terminal is supported at both ends by connecting the two ends to respective carriers. However, this method would have a major disadvantage. Namely, if a portion of the semi-finished terminal is deformed to become either convex or concave, the distance between the ends decreases, so the two carriers would be drawn toward the processing portion of the semi-finished terminal. However, the carriers are not easily deformed at this time, so instead the force would act on the semi-finished terminals themselves, and might twist or stretch the terminals undesirably between the carriers.

Furthermore, when the plate-shaped semi-finished terminal is subjected to press working, the semi-finished terminal elongates and becomes thinner. As a result, an outward force would be produced which acts on both carriers. Since the carriers are not easily deformed at this time, the force would tend to compress the semi-finished terminal. Consequently, the semi-finished terminal will deform in an undesirable manner.

SUMMARY OF THE INVENTION

The invention overcomes the above-described problems. It is thus an object of the invention to reliably supply semi-finished products to processing machines in a form which reduces the risk of the semi-finished products deforming.

To achieve the object, the invention provides a method of manufacturing products of predetermined shape by providing a pair of carriers, a plurality of semi-finished products, and for each semi-finished product, at least one deformable element. The carriers are arranged in parallel, the semi-finished products are arranged between the carriers (e.g. parallel with each other), and each of the semi-finished products are connected at two respective ends to the respective carrier. The connection of each semi-finished product to at least one of the carriers is by a deformable element.

The plurality of semi-finished products are supplied to a processing machine, which subjects each said semi-finished product to bending processing to deform the semi-finished product into the predetermined shape. During the bending processing, the at least one deformable element of each semi-finished product undergoes deformation to allow the semi-finished product to move relative to at least one of the carriers.

Thus, when the semi-finished product is bent, the semi-finished product may approach or move away from one of the carriers. Accordingly, a change in the length of the semi-finished product can be compensated for by a deformation of the deformable element of that semi-finished product without generating a force on the semi-finished product that would undesirably deform it. Consequently, it is possible to prevent the semi-finished product from being stretched and thus twisted, as well as from being compressed, and thus undesirably deformed.

Preferably, each semi-finished product is connected to one of the carriers by the respective deformable element and is also connected to the other carrier by a motion-resisting element which resists motion of the semi-finished product relative to the other carrier.

Since the deformable element is formed at only one end of the semi-finished product, when the deformable element is deformed, the semi-finished product only moves relative to one of the carriers, i.e., the end of the product which is connected to the other carrier does not move relative to that other carrier. Accordingly, the semi-finished product remains at a constant position relative to the other carrier. Accordingly, the position of the semi-finished product can be maintained with sufficient precision.

The pair of carriers, the plurality of semi-finished products and the deformable elements may be produced by a step of punching a section of sheet material (e.g., sheet metal) to a predetermined shape.

The invention is particularly suitable for the production of an electric terminal.

These and other objects of the invention will be described in or be apparent from the following description of preferred embodiments.

BRIEF DESCRIPTION OF THE DRAWINGS

The invention will be described in conjunction with the following drawings in which like referenced numerals designate like elements and wherein.

DETAILED DESCRIPTION OF PREFERRED EMBODIMENTS

A first embodiment of this invention will be described below with reference to FIGS. 1 to 7. For the sake of illustration, the embodiment is described in relation to the production of an electric terminal, but all features of the embodiment are applicable to the production of different products.

Figure 6:
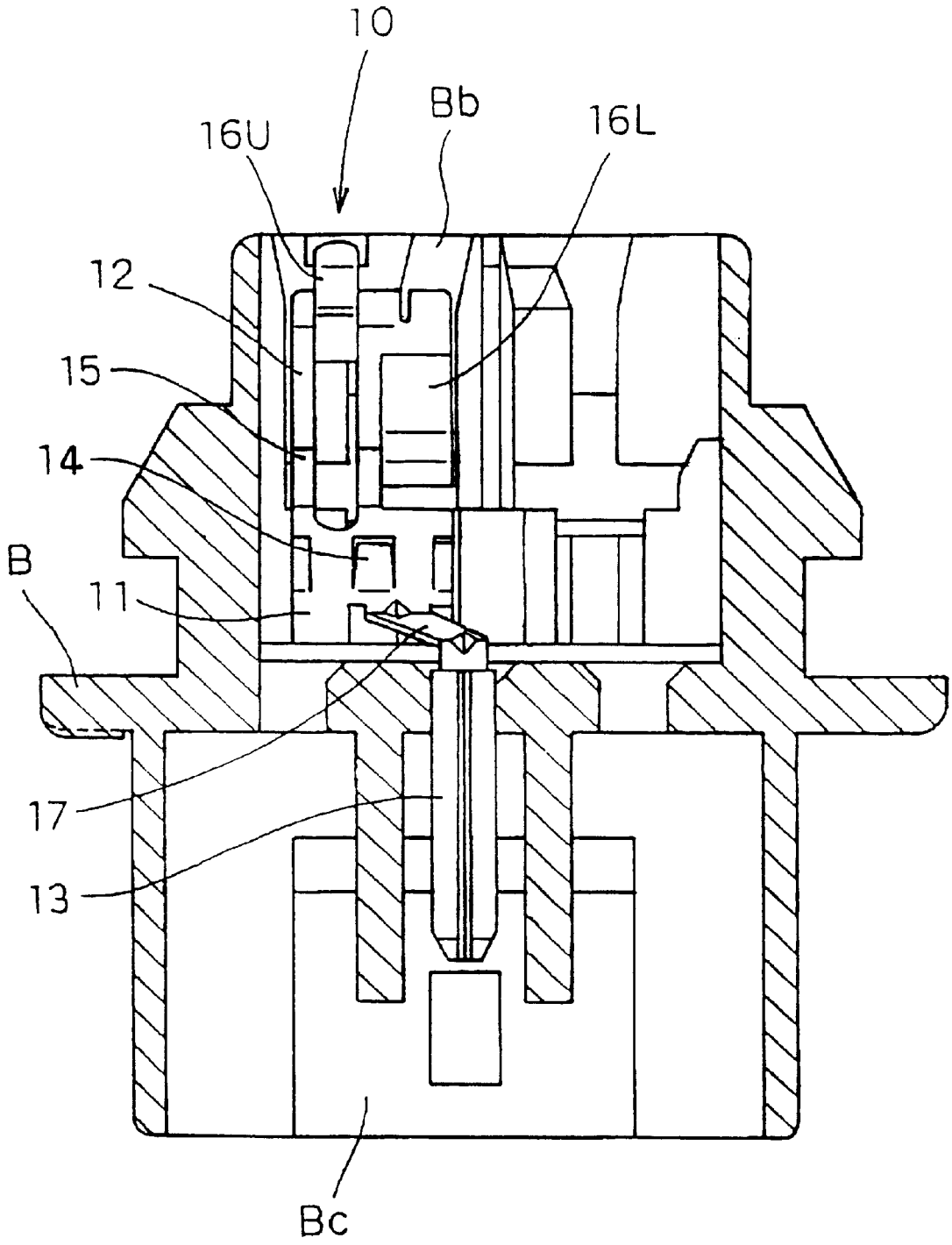
FIG. 6 is a sectional view of the terminal produced by the method of the first embodiment illustrating how the terminal can be used.
Figure 7:
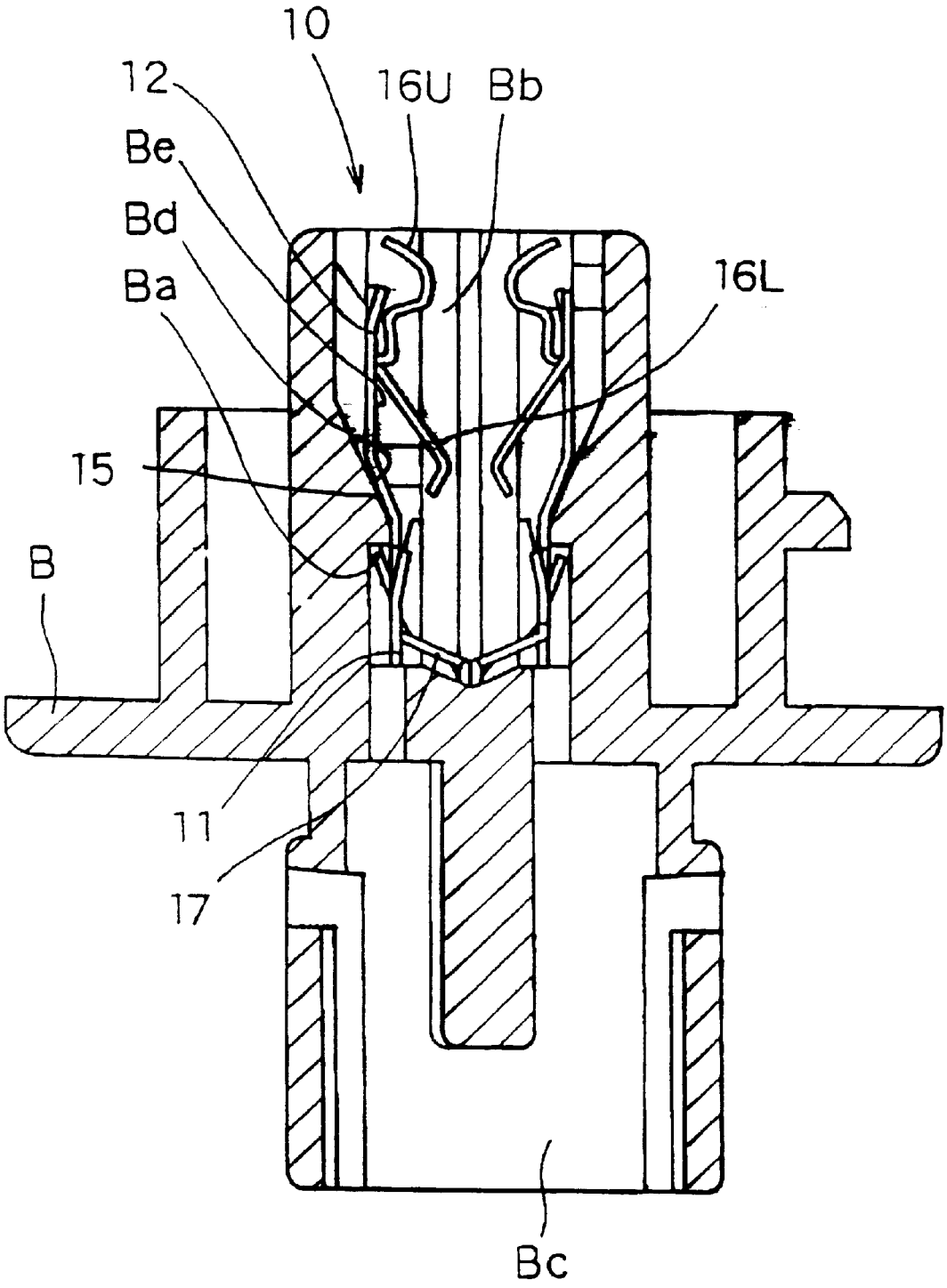
FIG. 7 is another sectional view of the terminal produced by the first embodiment illustrating how the terminal can be used.

As discussed below with reference to FIGS. 6 and 7, a terminal 10 produced by the first embodiment of this invention is suitable for installation within a light bulb socket B. The terminal 10 comprises upper and lower elastically deformable contact elements 16U and 16L, which, in use, are brought into contact with a contact element of a bulb (not shown), and a tab 13 that is connected with the terminal of a mating connector (not shown). As shown in FIGS. 6 and 7, the terminal 10 is installed in the light bulb socket B by inserting the terminal 10 downward into the light bulb socket B. A removal preventing element 14 of the terminal 10 then engages a removal preventing element Ba of the light bulb socket B. When the terminal 10 has been installed in the light bulb socket B, the upper and low elastic contact elements 16U and 16L are positioned inside a bulb-installing chamber Bb that is open towards an upper surface of the light bulb socket B. Additionally, the tab 13 is positioned inside a fit-in chamber Bc that is open towards a lower surface of the light bulb socket B. A portion of an inner wall of the bulb-installing chamber Bb located between the removal preventing portion Ba and the upper surface of the light bulb socket B is a tapered surface Bd. Thus, a corresponding tapered portion 15 of the terminal 10 can be positioned on the tapered surface Bd of the bulb-installing chamber Bb such that the tapered portion 15 is in close contact with the tapered surface Bd. A portion of the light bulb socket B located between the tapered surface Bd and the upper surface of the light bulb socket B is formed with a wide portion Be, such that, in use, an upper base portion 12 of the terminal 10 is positioned in close contact with the wide portion Be of the light bulb socket B.

Figure 1:
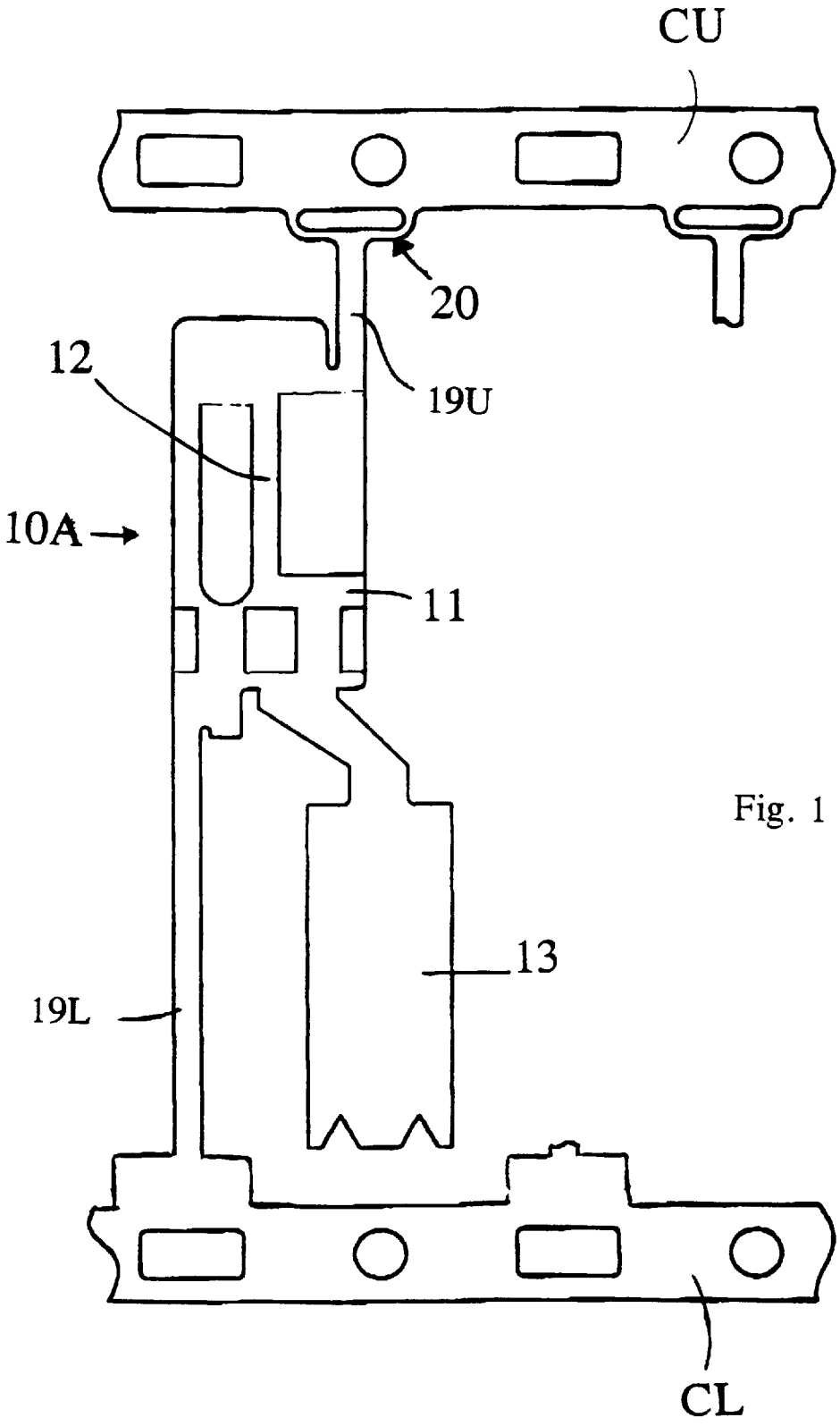
FIG. 1 is a front view of a semi-finished terminal supported between a pair of carriers in a first embodiment of the method according to this invention.

The configuration of a terminal will be described below with reference to FIG. 1, which shows a semi-finished terminal 10A, and FIG. 2 which shows how the semi-finished terminal illustrated in FIG. 1 appears after the semi-finished terminal 10A has been subjected to bending processing to transform the terminal 10A into the predetermined terminal shape.

A rectangular, plate-shaped, semi-finished terminal 10A, connected to a pair of upper and lower carriers CU and CL, is formed in a desired shape from sheet metal by press working. The semi-finished terminal 10A and the carriers CU and CL are substantially in one plane. Then, the semi-finished terminal 10A is shaped into a predetermined shape by press working, cutting, and bending. Finally, the semi-finished terminal 10A is cut off the carriers CU and CL to form the terminal 10. The semi-finished terminal 10A comprises the lower base portion 11 that is kept flush with the lower carrier. CL driving in the manufacturing process, the upper base portion 12 which is continuous with the lower base portion 11 and positioned upward (as viewed in FIG. 1) from the lower base portion 11, and the tab 13 which extends downward from the lower end of the lower base portion 11.

Figure 2:
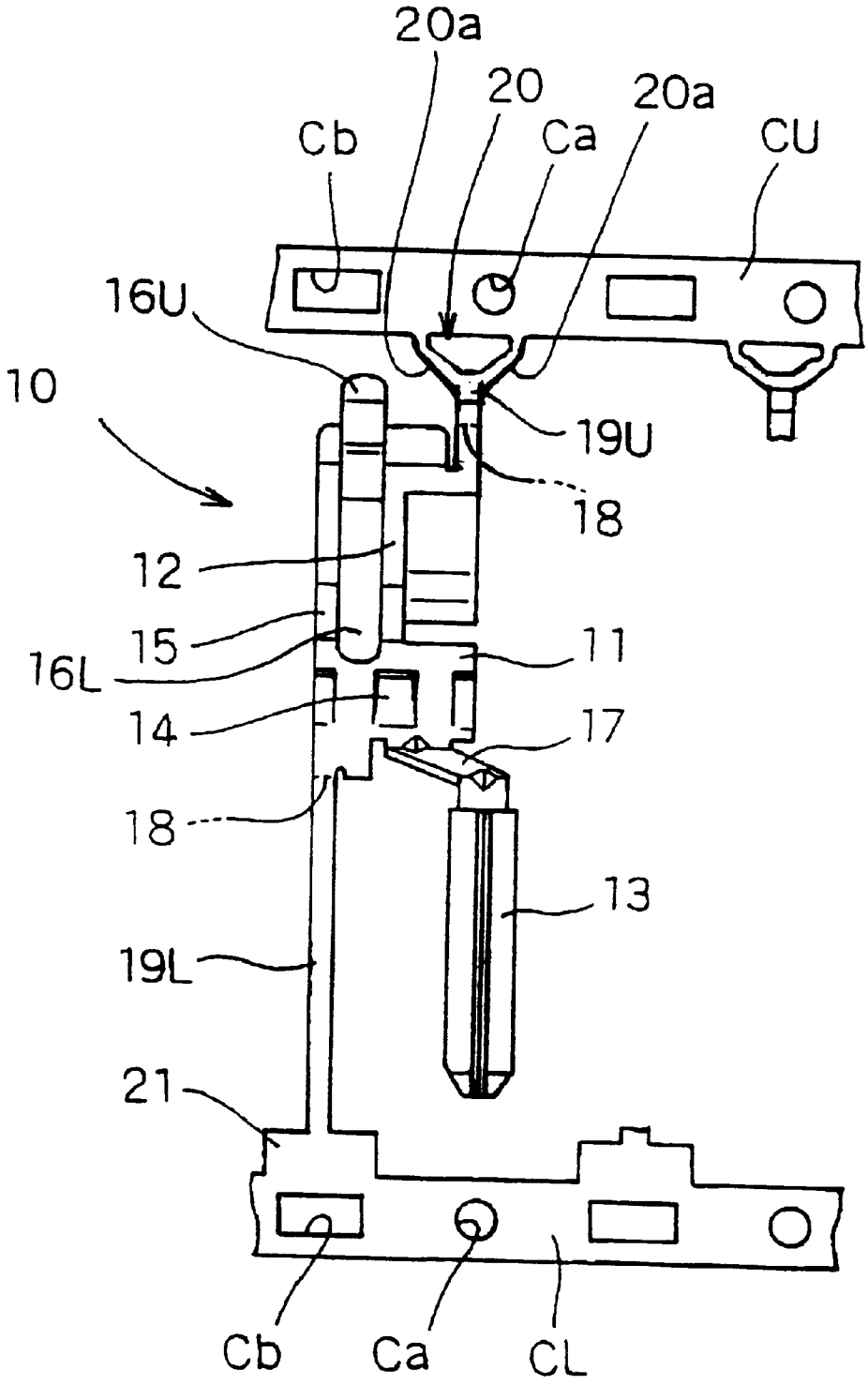
FIG. 2 is a front view of the semi-finished terminal illustrated in FIG. 1 after the terminal has been deformed into a terminal shape.
Figure 3A:
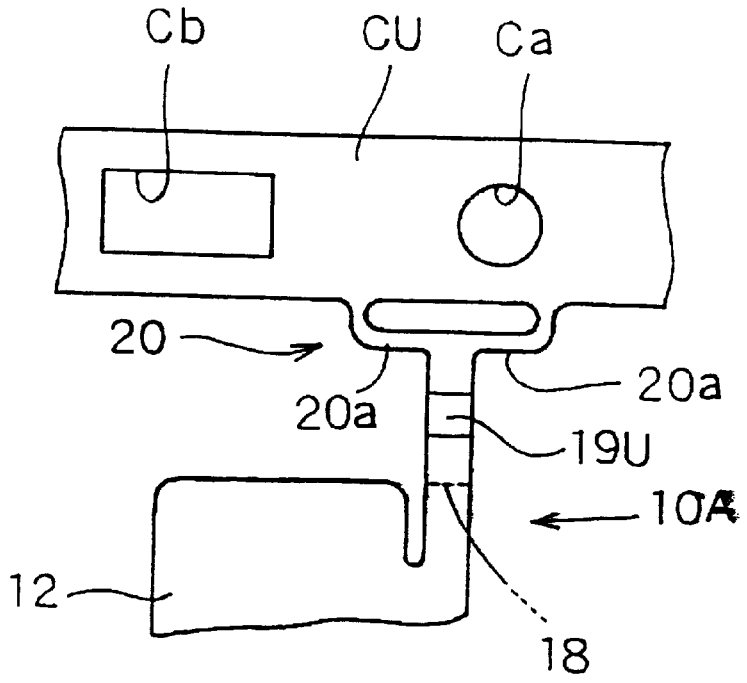
FIG. 3A is an enlarged view of a part of the semi-finished terminal illustrated in FIG. 1.
Figure 3B:
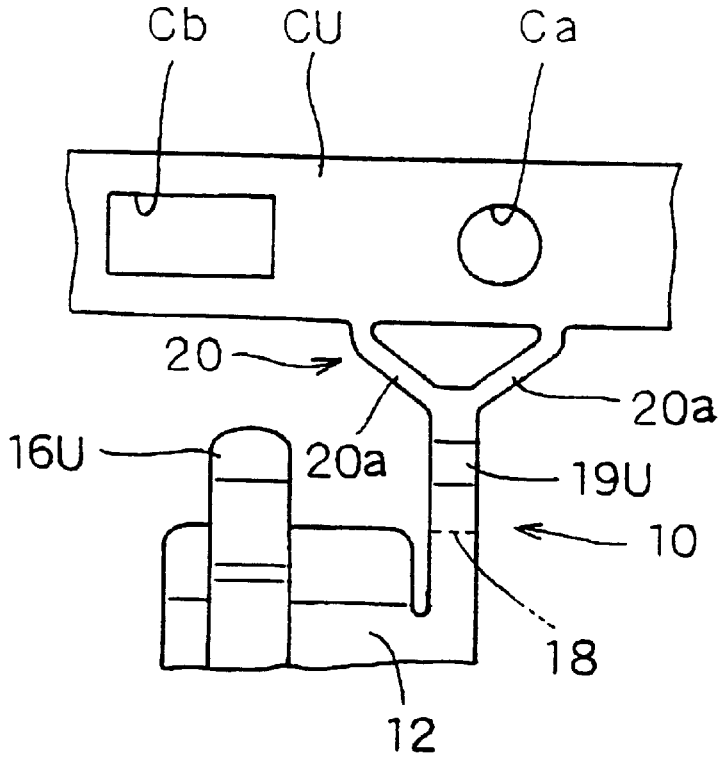
FIG. 3B is an enlarged view of a part of the deformed terminal illustrated in FIG. 2.
Figure 4:
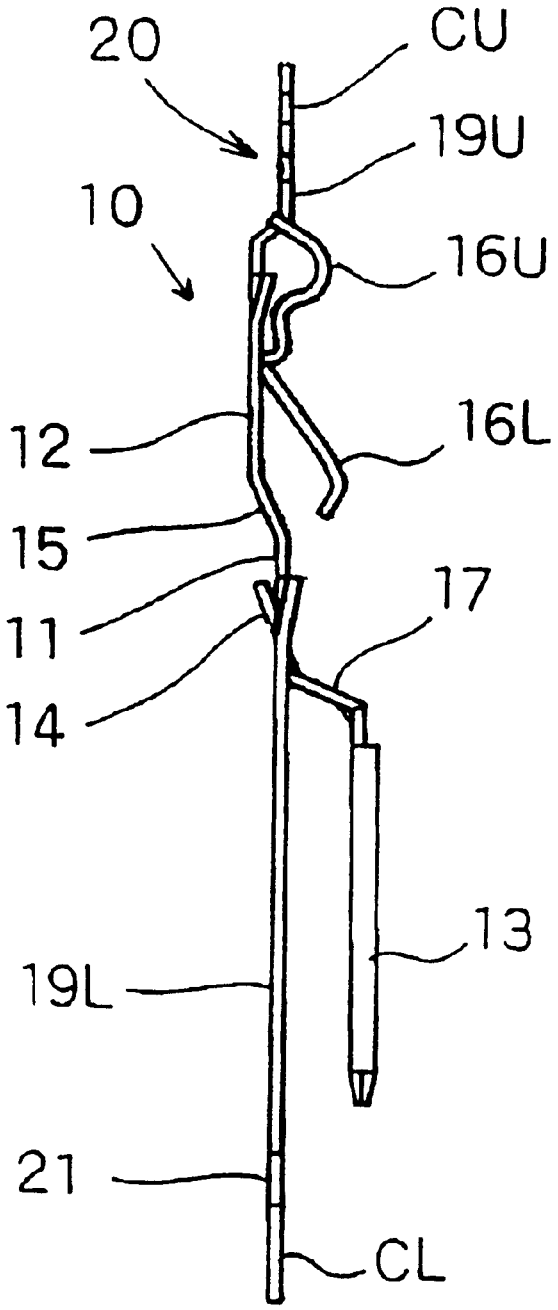
FIG. 4 is a side view of the deformed terminal illustrated in FIG. 2.
Figure 5:
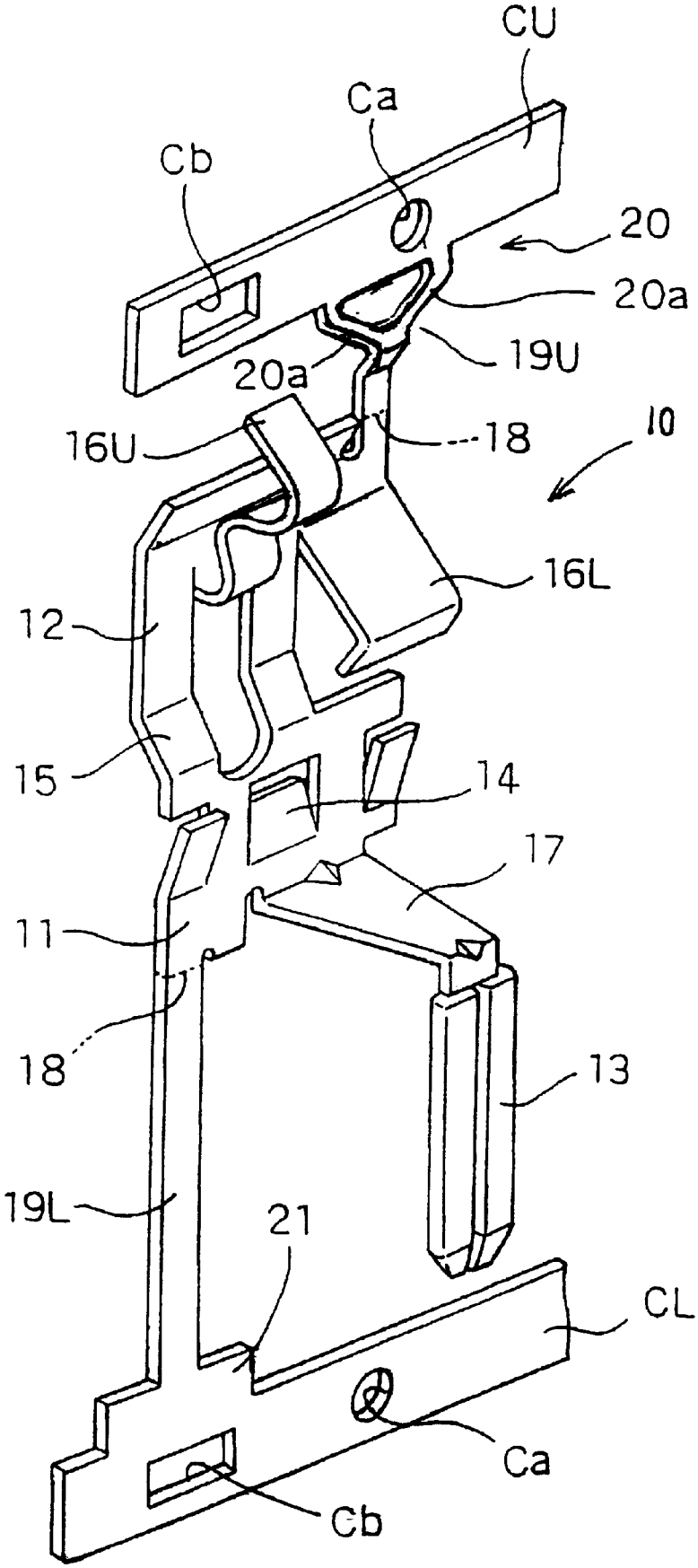
FIG. 5 is a perspective view of the terminal.

Turning now to FIG. 2, after subjecting the semi-finished terminal 10A to the bending processing, the removal preventing element 14 is bent backwardly (i.e., in the direction into the page of FIG. 2) from the lower base portion 11 by cutting and bending a portion thereof. The upper base portion 12 is shaped to incline backward from the lower base portion 11. The tapered portion 15 is interposed between the lower base portion 11 and the upper base portion 12. The curved upper elastic contact element 16U is formed by cutting and bending a portion of the upper base portion 12 frontward and folding a portion of the upper base portion 12 upward. A portion of the upper base portion 12 and a portion of the tapered portion 15 are then cut and bent downward and frontward to form the lower elastic contact element 16L.

The leg portion 17 extends downward toward the right front side continuously from the lower end of the lower base portion 11. A portion extending downward from the lower end of the leg portion 17 is formed into the tab 13 by folding right and left edges of the portion 17 forward (i.e., out of the plane of FIG. 2).

The method for manufacturing the terminal 10 will be described below.

As described above, a large number of semi-finished terminals 10A, integral with (i.e., formed as a one-piece unit) the pair of upper and lower carriers CU and CL, are produced in a predetermined shape by punching a sheet of metal material. The semi-finished terminals 10A are flush with one another over their surface. Then, the semi-finished terminals 10A are sequentially supplied to processing machines, such as a pressing machine (not shown) using pilot holes Ca and Cb formed on the upper and lower carriers CU and CL. The processing machines process the semi-finished terminals 10A into a predetermined shape by pressing, cutting, and bending. After the semi-finished terminal 10A has been processed into the predetermined shape, it is referred to herein by the reference numeral 10. When all processing is completed, each terminal 10 is cut at cut-off positions 18 located at the upper end of the upper base portion 12 and at the lower end of the lower base portion 11 by a cutting mechanism (not shown), to separate the terminal 10 from the pair of upper and lower carriers CU and CL. In this manner, a finished terminal 10 is obtained as a separate product.

When a semi-finished terminal 10A is connected to the pair of carriers CU and CL, the upper carrier CU is integral with (i.e., a one piece unit) the upper end of an upper supporting portion 19U extending upward (as viewed on FIG. 1) from the uppermost right end of the upper base portion 12 of the semi-finished terminal 10A, and the lower carrier CL is integral with (i.e., a one-piece unit with) the lower end of a lower supporting portion 19L extending downward from the left end of the lower base portion 11.

A deformable portion 20 is formed at the upper end of the upper supporting portion 19U. A pair of narrow branch portions 20*a* of the deformable portion 20 extend parallel to the upper carrier CU from the upper supporting portion 19U to the right and left sides, and both ends of both branch portions 20*a* are connected with the upper carrier CU. When an external force is applied downward to the upper supporting portion 19U such that the upper supporting portion 19U moves away from the upper carrier CU, the deformable element 20 deforms from the state shown in FIG. 3A in which the element 20 is parallel with the upper carrier CU, to the state shown in FIG. 3B in which the element 20 is oblique to the upper carrier CU. Thus, the upper supporting portion 19U is displaced in a direction away from the upper carrier CU (i.e., downward as shown on FIG. 1), without the upper supporting portion 19U being subjected to a concentration of stress and without the upper supporting portion 19U transmitting excess stress to the rest of the semi-finished terminal 10A.

A motion-resisting element 21 is formed at the lower end of the lower supporting portion 19L. The motion-resisting element 21 extends to the right and left sides from the lower end of the lower supporting portion 19L and is rectangular and plate-shaped. When an external force is applied upward to the lower supporting portion 19L, thereby displacing the lower supporting portion 19L from the lower carrier CL, the motion-resisting element 21 is not deformed. Thus, the lower supporting portion 19L is prevented from moving away from the lower carrier CL, i.e., upward as shown on FIG. 1. A rectangular pilot hole Cb for feeding the semi-finished terminal 10A to an automatic machine is formed proximate the motion-resisting element 21. Because the motion-resisting element 21, which is integral with the lower carrier CL, is plate-shaped and not linear-shaped, the motion-resisting element 21 is not deformed.

In processing the semi-finished terminal 10A, the lower carrier CL, the lower supporting portion 19L, and the lower base portion 11 are flush with one another from the start of the processing to completion.

On the other hand, the upper supporting portion 19U is bent during press working when the upper base portion 12 is displaced backward relative to the lower base portion 11. In bending the upper base portion 12, the upper part of the upper supporting portion 19U is flush with the upper carrier CU, as well as with the deformable element 20. The lower part of the upper supporting portion 19U is flush with the upper base portion 12 and is displaced backward.

When the semi-finished terminal 10A is processed by press working to be convex and/or concave, a force acts on the upper and lower carriers CU and CL in the direction between them. A claw (not shown) engages the pilot holes Ca and Cb, thus preventing deformation of the upper and lower carriers CU and CL. Therefore, the tensile force is transmitted to the semi-finished terminal 10A.

If the semi-finished terminal 10A is elongated by the tensile force, the semi-finished terminal 10A may be twisted due to non-uniform stress distribution in the semi-finished terminal 10A.

In the embodiment, however, because the deformable element 20 is formed on the upper supporting portion 19U, the upper part of the semi-finished terminal 10A is displaced in the direction away from the upper carrier CU, with the deformable element 20 being deformed. Consequently, the tensile force acting on the semi-finished terminal 10A is relieved. Accordingly, undesirable elongation of the region of the semi-finished terminal 10A between the portion of the semi-finished terminal, which is processed, and the upper carrier CU can be avoided. Thus, the semi-finished terminal 10A can be prevented from being twisted.

Furthermore, because during processing the upper and lower ends of the semi-finished terminal 10A are supported by the upper and lower carriers CU and CL, the semi-finished terminal 10A can be held in a stable position, compared with the prior art arrangement in which the semi-finished terminal 10A is only supported by either an upper carrier CU or a lower carrier CU. Thus, the semi-finished terminal 10A can be processed with high accuracy.

Because the motion-resisting element 21 is formed between the semi-finished terminal 10A and the lower carrier CL, the semi-finished terminal 10A remains at a constant position relative to the lower carrier CL. Accordingly, when the semi-finished terminal 10A is supplied to a processing machine using the pilot holes Ca and Cb, the semi-finished terminal 10A can be placed accurately in position, and thus processing can be accomplished with high precision.

Figure 8:
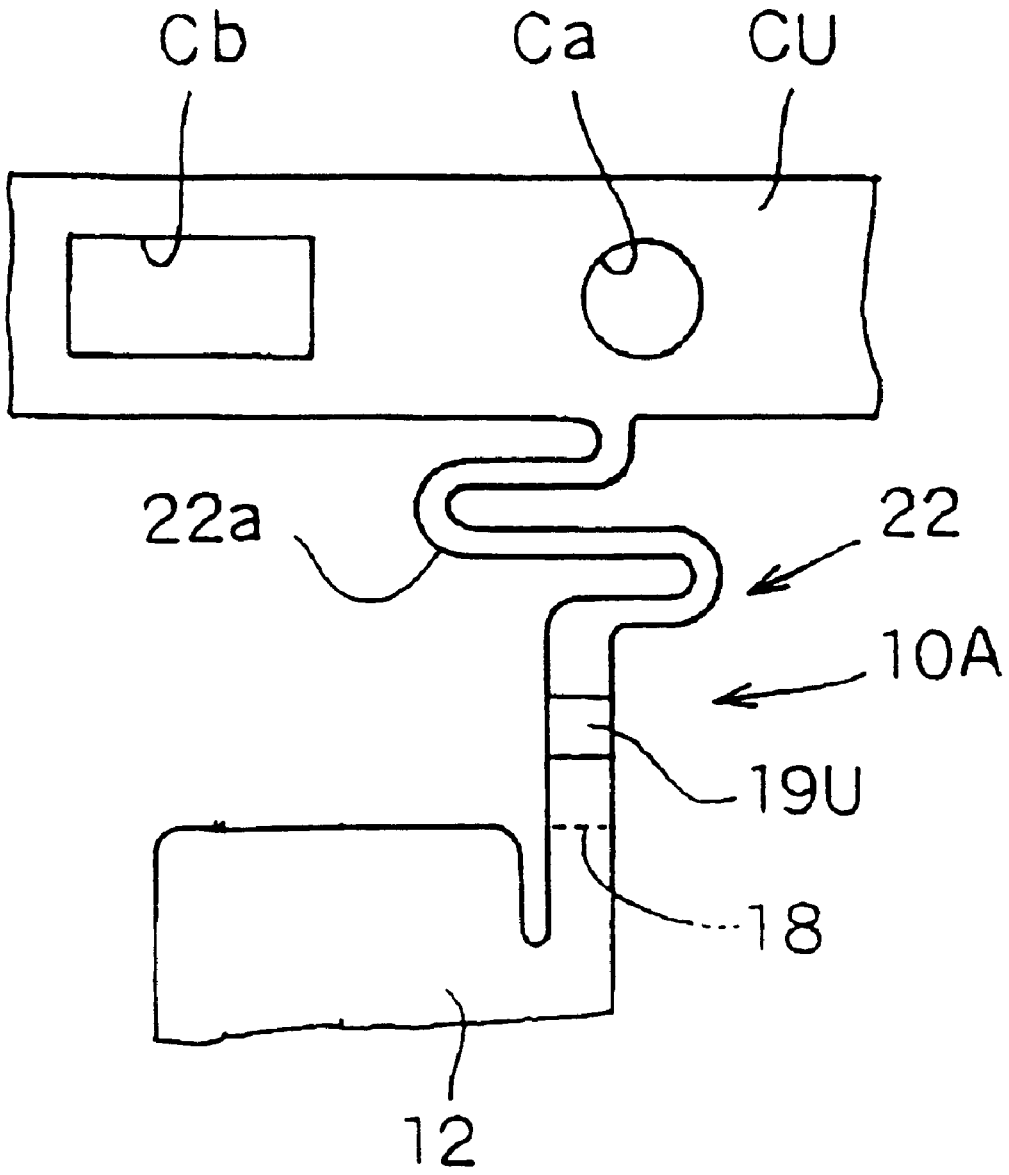
FIG. 8 is a front view of a deformable element used in a second embodiment of the method according to this invention.

A second embodiment of the invention will be described below with reference to FIG. 8.

In the second embodiment, the deformable element 22 is different from the deformable element 20 of the first embodiment while the other constituent parts of the second embodiment are similar to those of the first embodiment. Thus, the same elements are denoted by the same reference numerals, and their operation and effect are not described below.

The deformable element 22 includes a narrow zigzag portion 22*a* connected at respective ends to the upper end of the upper supporting portion 19U and to the upper carrier CU. Deformation of the zigzag portion 22*a* allows the semi-finished terminal 10A to move away from the upper carrier CU.

Figure 9:
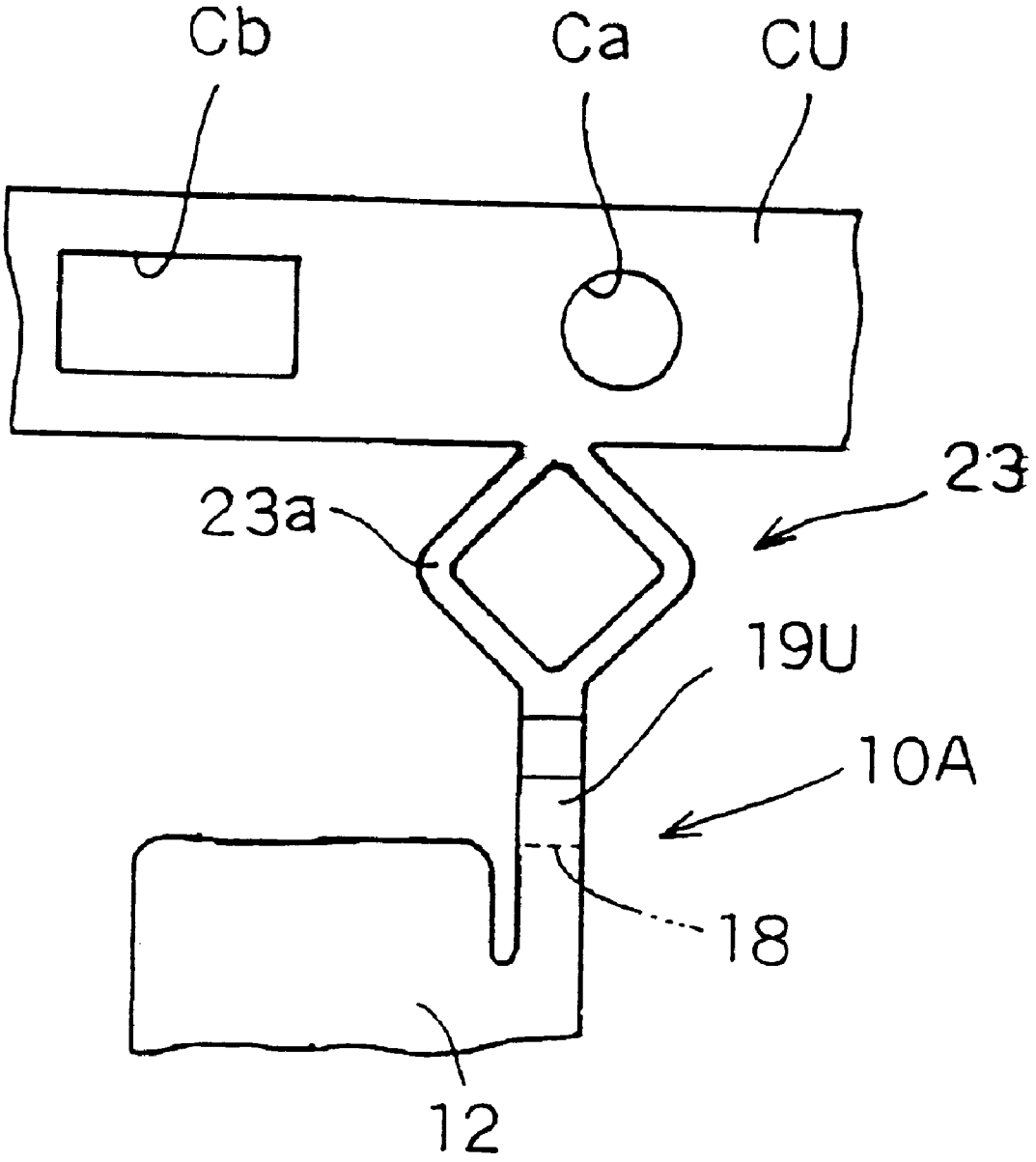
FIG. 9 is a front view of a deformable element used in a third embodiment of the method according to this invention.

A third embodiment of the invention will be described below with reference to FIG. 9.

In the third embodiment, the deformable element 23 is different from the deformable elements 20 and 22 of the first and second embodiments, respectively. Other constituent parts of the third embodiment are similar to those of the first embodiment, and are denoted by the same reference numerals.

The deformable element 23 of the third embodiment includes a rhombic element 23*a* connected with the upper end of the upper supporting portion 19U and the upper carrier CU. Deformation of the rhombic element 23*a* allows the semi-finished terminal 10A to move away from the upper carrier CU.

While the invention has been described in conjunction with specific embodiments thereof, it is evident that many alternatives, modifications and variations may be apparent to those skilled in the art. Accordingly, the preferred embodiments of the invention as set forth herein are intended to be illustrative, not limiting. Various changes may be made without departing from the spirit and scope of the invention.

For example:

(1) Although in the illustrated embodiments the deformable element is illustrated as being formed only on the upper end of the semi-finished terminal, alternatively, deformable elements may be formed on both the upper and lower ends of the semi-finished terminal.

(2) Although the embodiments of the terminal are illustrated as being used in a light bulb socket, the method of the invention may be applied to terminals for other uses.

(3) Each deformable element may be deformable in such a way as to allow the end of the semi-finished terminal to which the terminal is connected to approach the respective carrier.

(4) Although the product is an electric terminal in the illustrated embodiments, the invention is applicable to the production of a different product, such as a bus bar.

What is claimed is:

1. A method of manufacturing products of pre-determined shape, comprising:

arranging a first carrier and a second carrier in parallel to each other;

arranging a plurality of semi-finished products between the first and second carriers, each semi-finished product having at least a first end and a second end, said each semi-finished product being connected to the first carrier at the first end and the second carrier at the second end, wherein the connection of said each semi-finished product to at least one of the first and second carriers is by at least one deformable element; and supplying the plurality of semi-finished products to a processing machine which deforms said each semi-finished product into the predetermined shape using a bending process, wherein said at least one deformable element of said each semi-finished product deforms during the bending process, thereby allowing said each semi-finished product to move relative to at least one of the first and second carriers.

2. The method according to claim 1, wherein the connection of said each semi-finished product to said at least one of the first and second carriers is by said at least one deformable element, further comprising connecting said each semi-finished product to either one of the first and second carriers using a motion-resisting element which resists motion of each semi-finished product relative to the other carrier.

3. The method according to claim 2, further comprising integrating said at least one deformable element and said motion-resisting element with their respective carriers.

4. The method according to claim 1, further comprising separating said each semi-finished product from the first and second carriers after the processing device has processed said each semi-finished product.

5. The method according to claim 1 wherein the manufactured products are electric terminals.

6. The method according to claim 1, wherein said at least one deformable element has narrow branch portions parallel to said at least one of the first and second carriers to which said each deformable element is connected.

7. The method according to claim 1, wherein said at least one deformable element has a narrow zigzag portion.

8. The method according to claim 1, wherein said at least one deformable element has a rhombic portion.

* * * * *